United States Patent [19]

Deimerly et al.

[11] Patent Number: 4,541,565

[45] Date of Patent: Sep. 17, 1985

[54] AIR POWERED RECIPROCATOR

[76] Inventors: Thomas R. Deimerly, 308 Orchard Dr.; Rowland M. Van Heukelom, 2103 S. Sixth St., both of Marshalltown, Iowa 50158

[21] Appl. No.: 470,552

[22] Filed: Feb. 28, 1983

[51] Int. Cl.[4] ..... B05B 3/18

[52] U.S. Cl. ..... 239/178; 239/186

[58] Field of Search ..... 239/178, 184–186, 239/191

[56] References Cited

U.S. PATENT DOCUMENTS

| | | | |
|---|---|---|---|
| 3,301,488 | 1/1967 | Norris | 239/186 |
| 3,985,161 | 10/1976 | Nelson | 239/186 |
| 4,010,203 | 3/1977 | Aylon | 239/186 |
| 4,076,033 | 2/1978 | Busse et al. | 239/186 |
| 4,167,440 | 9/1978 | Falk | 239/186 |

*Primary Examiner*—Andres Kashnikow
*Assistant Examiner*—Daniel R. Edelbrock
*Attorney, Agent, or Firm*—Zarley, McKee, Thomte, Voorhees & Sease

[57] ABSTRACT

As apparatus for and method of pneumatically reciprocating spraying means linearly between two end points with a minimum or negligible amount of lag or return time at either end point which includes an oscillating piston inside a cylinder member, said piston having an outwardly extending arm responsive to the movement of said piston to which a spraying means is rigidly attached. An air logic control circuitry controls and directs regulated pressurized air to and from opposite ends of the cylinder, each end receiving and exhausting different pressures of air at different times and in different amounts so as to cause the piston to oscillate in response to the differing air pressures at its opposite sides. Lag or return time is minimized by sensing when the piston is approaching an end point and introducing higher pressure air in front of the piston while at the same time dumping or exhausting pressurized air behind the piston to cause its immediate return.

7 Claims, 3 Drawing Figures

AIR POWERED RECIPROCATOR

BACKGROUND OF THE INVENTION

This invention relates to reciprocators and oscillators for spray guns and in particular to pneumatically powered reciprocators and oscillators for spray guns having minimal or negligible lag or return time.

Automatic industrial finishing requires equipment which can deposit uniform and consistant finishes while at the same time being economical and efficient with regard to operating costs and amount of finishing used.

A primary example of applications for automatic industrial finishing equipment is on power conveyor lines where unfinished articles continuously pass by the finishing equipment. In this one-pass situation, it is extremely critical that the finishing is deposited comprehensively and uniformly. Typical equipment utilize reciprocators (also called oscillators) which oscillate finishing guns adjacent to the unfinished products as they pass by so that the finish is deposited in an even manner.

Examples of the finishing substances which are applied by these devices are paints, electrostatic powders and liquids, liquid lacquers and enamels, adhesives, solvents, and cleaners. Additionally, sometimes foam injections are applied by this equipment. Many of these substances are volatile and therefore a critical requirement of finishing equipment in these applications is that they provide an explosion-proof atmosphere. This generally means that electric or gasoline powered reciprocators cannot be used because they present the danger of sparks and heat in a volatile atmosphere.

Many conventional reciprocators used today are hydraulically powered, using hydraulics to oscillate the finishing guns while maintaining an explosion-proof atmosphere. Hydraulic powered reciprocators are expensive, cumbersome and relatively difficult to maintain and repair because they require auxiliary equipment such as pumps and power units.

Attempts have been made to perfect a pneumatically powered reciprocator which would be less expensive, easier to transport, and more economical to operate and maintain. However, these attempts were not successful because a noticeable and detrimental lag or return time existed at opposite ends of the gun stroke which produced undesirable finishing results on the products. For example, the lag or hesitation at the end points would cause excessive amounts of finish to be deposited at those points on those products which thereby caused running or excessive thickness of finish.

Therefore, it is a principle object of this invention to provide a pneumatically powered reciprocator which solves the above mentioned problems in the art.

A further object of this invention is to provide a pneumatically powered reciprocator which eliminates or provides a negligible lag or return time at the end points of the reciprocator stroke.

A further object of this invention is to provide a pneumatically powered reciprocator which requires only one power source.

Another object of this invention is to provide a pneumatically powered reciprocator which is adjustable and operable to reciprocate finishing guns in any linear plane.

Another object of this invention is to provide a pneumatically powered reciprocator which utilizes pressurized air dump valves to accomplish elimination of lag.

A further object of this invention is to provide a pneumatically powered reciprocator which utilizes at least dual pressure to accomplish operability from one pressurized air souce.

A further object of this invention is to provide a pneumatically powered reciprocator which is adjustable in stroke length and oscillation speed and has highly accurate speed matching between direction of travel of the spray guns and has precise travel speed.

A further object of this invention is to provide a pneumatically powered reciprocator which is simple in design and operation.

Another object of this invention is to provide a pneumatically powered reciprocator which is easy to maintain and repair.

A further object of this invention is to provide a pneumatically powered reciprocator which is durable, economical, efficient, and easily maneuverable and moveable.

Additional objects, features, and advantages of the invention will become apparent with reference to the accompanying specification and drawings.

SUMMARY OF THE INVENTION

This invention utilizes an apparatus for and method of oscillating a piston within a cylinder so that no lag time exists at the return end points. The method consists of oscillating a piston by applying differential pressures to opposite sides of the piston at appropriate times to send it in first or second directions depending upon its position within the cylinder. A lag or return delay time at the end points of the stroke of the piston is eliminated or minimized by sensing when the piston has reached an end limit position and then signaling an air logic control circuitry that such a position has been reached. Pressurized air is introduced in front of the piston and the pressurized air behind the piston and opposite the direction of travel of the piston is exhausted from that side of the piston to provide a lower pressure area for the piston to reverse and return to.

The apparatus to accomplish this method includes a cylinder having opposite ends wherein the piston member is moveable therebetween. Pressurized air lines are communicated with the opposite ends of the cylinder and allow for both the entry and exhaust of pressurized air from the respective ends. Air logic circuitry includes high and low pressure regulators to provide dual pressure to the system, if needed, and air lubrication and filtering means and an on and off valve. No-lag oscillation is accomplished by utilizing a directional control valve in association with a pressure dump valve. End limit valves having mechanically tripped actuators are positioned so that when the piston reaches either end limit valve, it provides a signal to the directional control valve to supply pressurized air in front of the piston and which in turn causes the pressure dump valve to exhaust pressurized air behind the piston or on the side opposite to the direction of travel of the piston so that the piston immediately reverses directions.

Additionally, it should be noted that a speed control valve can be added to the air logic control circuitry to adjust the oscillation speed of the piston by controlling the amount of air exhausted.

DETAILED DESCRIPTION OF THE PREFERRED EMBODIMENT

Figure 1:
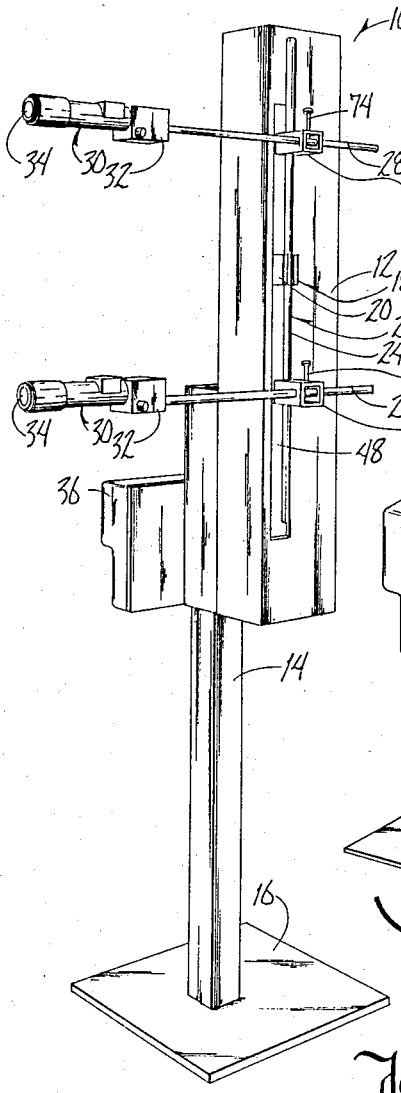
FIG. 1 is a perspective view of the invention.

In reference to the drawings and particularly FIG. 1, there is shown a pneumatic powered oscillator or reciprocator 10 in accordance with the invention. A housing 12 is supported by a post 14 which is connected at its lower end to base 16. Base 16 provides stability for the oscillator 10 when in operation and post 14 can be selected to hold housing 12 at a sufficient height for its desired use.

A reciprocating arm 18 extends out of housing 12 to an attachment bracket 20 which supports a spraying apparatus framework 22. In the preferred embodiment, spraying apparatus framework 22 consists of attachment rod 24 which is attached to attachment bracket 20 generally in its middle section and has attachment members 26 removeably and adjustably attached along its length on either side of attachment bracket 20. Spray gun extensions 28 are elongated rods which are removeably and adjustably attached along their length to attachment members 26. Spray guns 30, which are operably connected to a finishing product supply by hoses and other apparatus (not shown), are attached to adjacent ends of spray gun extensions 28 by mounting members 32. Mounting members 32 can be adjustable so as to change the orientation of spray nozzles 34 at the end of spray gun 30 to change the direction of spray.

The structure of spraying apparatus framework 22 is such that one or more spray guns can be attached to framework 22 and each such spray gun can be adjusted with respect to its vertical position along attachment rod 24, its horizontal position with respect to attachment rod 24 and its angular orientations with respect to spray gun extensions 28. Thus, for different applications, spray guns 30 can be adjusted and secured easily and with a minimum amount of work.

A control housing 36 contains the components of the air logic circuitry which controls the movement of reciprocating arm 18 and therefore spraying apparatus framework 22 and spray guns 30.

Figure 2:
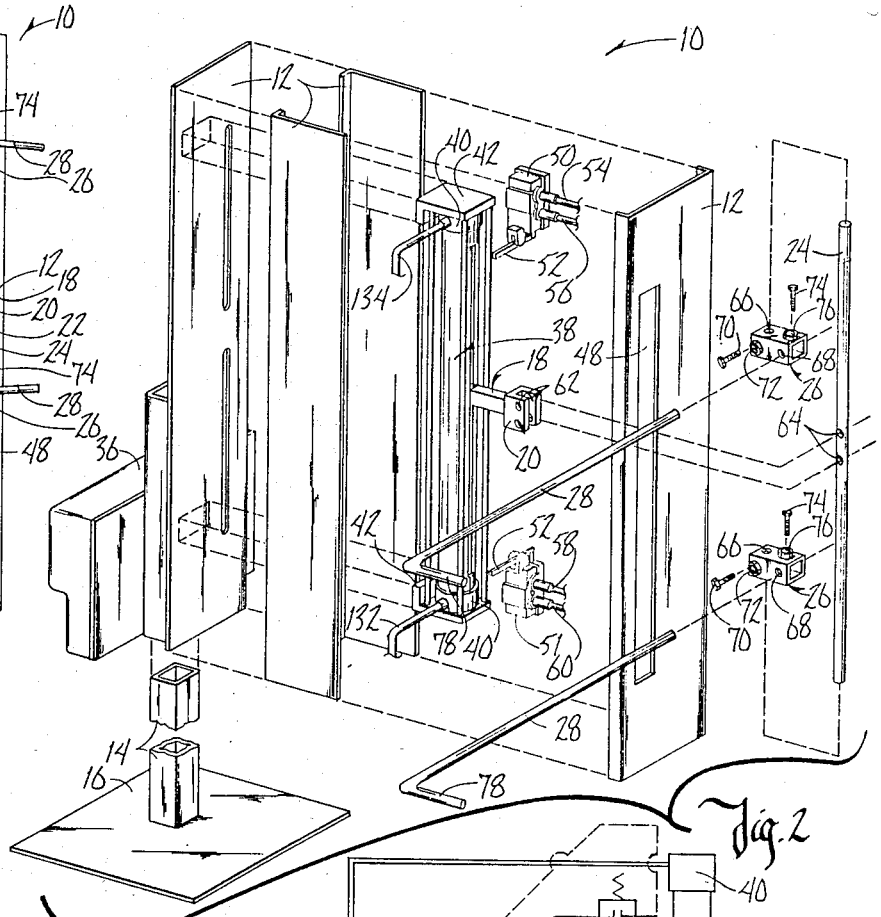
FIG. 2 is an exploded perspective view of the invention.

Referring now to FIG. 2, the structural cooperation of the interior parts of housing 12 and spraying apparatus framework 22 can be more clearly seen. Housing 12 can be comprised of four elongated rectangular panels adjoined so as to form an elongated rectangular tube. A cylinder 38 having end caps 40 is secured within a cylinder holding cage 42 which in turn is secured to the interior of housing 12. Air tubes 44 are connected to end caps 40 and are in fluid communication with the interior of cylinder 38.

A piston 46 (shown schematically in FIG. 3) sealingly is fitted within cylinder 38 and is slidably moveable between end caps 40 in response to varying air pressures applied to its opposite sides. Reciprocating arm 18 is moveably responsive to the movement of piston 46, and extends through elongated slot 48 in the side wall of housing 12 so that spraying apparatus framework 22 can be mounted upon attachment bracket 20.

Cylinder 38 with piston 46 and arm 18, in the preferred embodiment, is a Magneband Rodless Pneumatic Cylinder with a 1½ inch cylinder bore, made by Tol-o-matic, Inc. of Minneapolis, Minn.

End limit valves 50 are adjustably mounted inside of housing 12 at selected positions generally adjacent end caps 40 to determine the length of the stroke of reciprocating arm 18. End limit valves 50 have trip switches 52 which engage and are deflected by reciprocating arm 18 as it passes. Top end limit valve 59 has air hoses 54 and 56 attached in fluid communication with it while bottom end limit valve 51 has air hoses 58 and 60 attached in fluid communication to it. Upon the tripping of trip switch 52, valving means (not shown) in the interior of either end limit 50 or 51 is actuated so as to send a signal to air logic circuitry contained in control housing 36 to reverse the direction of piston 46. End limit valves 50,51 can be similar to Model 31P valves made by Humphrey Products of Kalamazoo, Mich. including as actuators trip switches 52.

Spraying apparatus framework 22 is first rigidly attached to attachment bracket 20 of reciprocating arm 18 by bolting attachment rod 24 to attachment bracket 20 through double apertures 62 in opposite sides of U-shaped attachment bracket 20 and apertures 64 in attachment rod 24. Attachment members 26 can be rectangular in cross section tube members having aligned apertures 66 in top and bottom opposite sides and aligned apertures 68 in vertical opposite sides. Aligned apertures 66 are of sufficient diameter to allow placement of attachment members 26 over attachment rod 24 whereas aligned apertures 66 are of sufficient diameter to allow the slidable engagement therethrough of spray gun extensions 28. Attachment members 26 are therefore slidably adjustable along attachment rod 24 and are securable by means such as threaded bolts 70 through threaded apertures 72 in a vertical wall of attachment members 26 so that the end of threaded bolts 70 can be threadably secured and tightened against attachment rod 24 to hold attachment members 26 in secure position. Likewise, spray gun extensions 28 are adjustably securable along their length at aligned apertures 68 by threading down threaded bolts 74 through threaded apertures 76 against spray gun extensions 28. Bent ends 78 of spray gun extensions 28 facilitate the adjustable attachment of mounting members 32 for spray guns 30.

Housing 12 is securely mounted to the upper end of post 14 which is in turn rigidly attached to base 16 which supports oscillator 10 in a stable and secure position to the floor or other flat surface or a moveable carriage.

Figure 3:
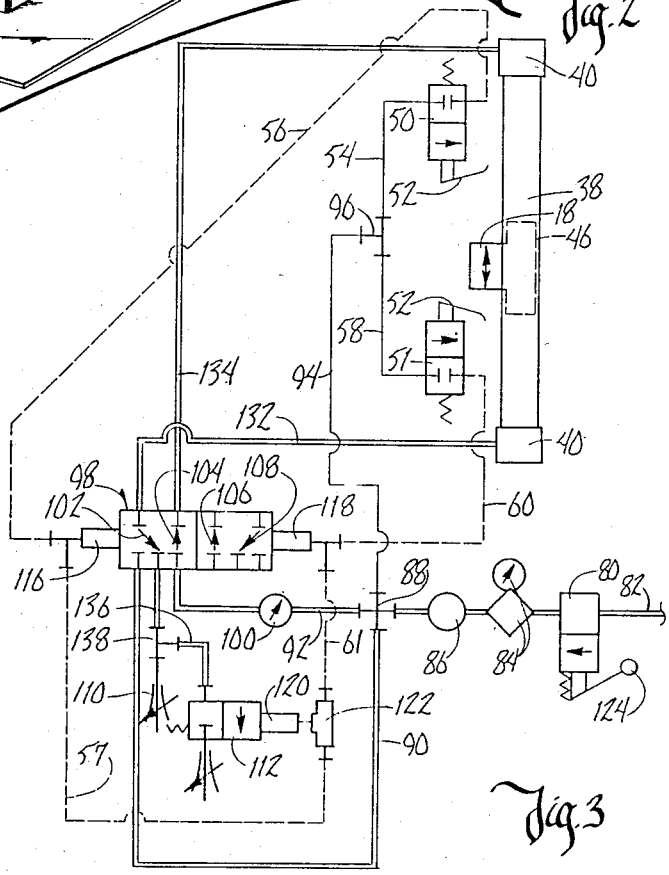
FIG. 3 is a schematic of the air logic control circuitry and operable elements of the invention.

The air logic circuitry for supplying pressurized air to cylinder 38 to oscillate piston 46 is shown by the schematic in FIG. 3. Cylinder 38, piston 46, and end limit valves 50 and 51 are operatively connected to a number of pneumatic hoses originating in the air logic circuitry. Pressurized air is supplied to the system by a pressured air source (not shown) and enters a mechanically operated on/off valve 80. On/off valve 80 can take on a number of configurations, and in the preferred embodiment consists of a manually controlled lever having a first position which does not allow passage of pressurized air through air hose 82, and a second position which fully allows the pressurized air to pass.

A combination filter/regulator 84 is connected in fluid communication with on/off valve 80 by air hose 82. Filter/regulator 84 serves to filter out undesired particulate matter in the pressurized air and also provides a regulated, monitorable, and adjustable supply of pressurized air to the air logic circuitry. Filter/regulator 84 can be of the type such as Model No. CB0-02-000 made by the Wilkerson Corporation of Englewood, Colo.

A lubricator 86 is then serially connected to air hose 82 after filter/regulator 84 and serves to introduce an aerosol of lubricant into the air stream, which is then carried to the pneumatic production tools and components to increase the life of this equipment. In the preferred embodiment a Wilkerson Model L10-02-000 lubricator can be used.

Air hose 82 ends at four-way junction 88. Pressure lines 90 and 92 are attached to two of the branches of the junction 88 and are depicted by double lines. The third junction attaches to pilot pressure line 94 which is designated by a single line.

Pilot pressure line 94 extends to T-junction 96 which splits pilot pressure line 96 into two branches (designated by numbers 54 and 58), each going to end limit valves 50 and 51, respectively. Pressure line 90 extends to directional control valve 98 whereas pressure line 92 likewise passes to directional control valve 98 after passing through low pressure regulator 100 which can be a Wilkerson model R10-02-000. Low pressure regulator 100 is adjustable to introduce a desired pressure of air less than or equal to the pressurized air initially input into the system and in the preferred embodiment is adjusted to provide a pressure substantially lower than that flowing through pressure line 90 in order to present dual pressures at the inputs to directional control valve 98. Dual pressures are especially significant to the preferred embodiment as shown in the drawings because cylinder 38 is vertically disposed so that less air pressure is needed to drive piston 46 downward than is needed to drive it upward. Low pressure regulator 100 is therefore adjusted to compensate for the gravitational load of and equalize the upward and downward speed of piston 46.

Directional control valve 98 serves to both supply pressurized air to opposite sides of piston 46 according to its desired direction of travel, and also to provide an exhaust outlet for exhausted pressurized air required to reverse the direction of piston 46 without noticable lag time. In the preferred embodiment, AAA Products International of Dallas, Tex., model No. RR2 pilot operated and button bleeder valve is utilized. As can be seen in FIG. 3, directional control valve 98 is a five-way air valve meaning that there are five possible paths for pressurized air to flow through valve 98. In the preferred embodiment, only four such paths are used as designated by the arrows which will be referred to as air paths 102, 104, 106, and 108. The direction of the arrows designates the direction which air passes.

Valve 98 functions by having two basic positions which reflect two different flow patterns. When in a first position, the flow pattern is determined by air paths 102 and 104 as shown in FIG. 3. Upon activation by lower end limit valve 51, valve 98 assumes the flow pattern as reflected by air paths 104 and 106.

In the first position of directional control valve 98, air pathway 102 connects the lower end of cylinder 38 with speed control valve 110 and pressure dump valve 112. Air path 104 connects pressure line 92, carrying lower pressurized air, to the top end of cylinder 38. In the second position of directional control valve 98, air path 106 connects high pressure air line 90 with the lower end of cylinder 38 while air path 108 connects the upper end of cylinder 38 with speed control valve 110 and pressure dump valve 112.

Directional control valve 98 is actuated by signal lines 56 and 60 (designated by dashed lines) from end limit valves 50 and 51, respectively. End limit valves 50 and 51 are simple on/off valves which are actuated by the mechanical tripping of trip switches 52 by arm 18. Once actuated, end limit valve 50 or 51 allows the passage of pressurized air from either pilot pressure branch line 54 or 58 through either signal line 56 or 60 to either left solenoid 116 or right solenoid 118 of directional control valve 98. Only one solenoid 116 or 118 is actuated at any one time and once actuated either presents air paths 102 and 104 or 106 and 108 respectively as the air flow pattern.

Speed control valve 110 basically is an adjustable exhaust valve to adjustably control how much or how little air is continuously vented during operation. It works in conjunction with directional control valve 98 and pressure dump valve 112 to dump or exhaust pressurized air from the side of piston 46 opposite to the direction of travel when either end limit valve 50 or 51 is actuated by trip switch 52. Speed control valve 110 can be a model KLN needle valve made by Rego Company of Chicago, Ill.

Pressure dump valve 112 is an off/on valve similar to end limit valves 50 and 51 and on/off valve 80 but is solenoid controlled by solenoid 120. Pressure dump valve 112 can be an assembly of valve model 31P with air pilot operator model 341A, both made by Humphrey Products. Solenoid 120 is controlled by shuttle member 122 which is activated by signal lines 114. Shuttle member 122 can simply be a two-way valve with one output connected to solenoid 120 and can be shuttle valve model S125 of Humphrey Products.

In operation, pneumatic powered oscillator 10 functions as follows. In its vertical configuration, once shut down, the gravitational pull on piston 46 causes piston 46 to settle in or near the bottom of cylinder 38. By pulling lever 124 of on/off valve 80, pressurized air originating from a pressurized air power source is passed through air tube 82 and on/off valve 80 into filter/high pressure regulator 84 which removes undesired liquid and suspended solids and stabilizes and supplies a maximum regulated pressure air to the system. This regulated and filtered air is then passed to lubricator 86 and from there is passed by air tube 82 to four-way junction 88.

Thus, there is high pressure air passed to pilot pressure line 94, pressure line 92 and pressure line 90. Since piston 46 has fallen to a position adjacent to the lower end of cylinder 38, trip switch 52 of lower end limit valve 51 will have been deflected by reciprocating arm 18 so that end limit valve 51 will provide an open channel for air to pass through in the direction of the arrow indicated in FIG. 3. High pressure air existing in lower branch 58 of pilot line 94 will therefore pass through lower end limit valve 51 into signal line branch 60 which is connected to solenoid 118 of directional control valve 98. Signal branch 60 therefore carries high pressure air to solenoid 118 thereby actuating solenoid 118 to cause the flow pattern schematically represented by 106 and 108 to be presented in directional control valve 98. This causes high pressure air existing in pressure line 90 to be passed through directional control valve 98 along air path 104 into pressure line branch 132 which carries the high pressure air to the lower end of cylinder 38 thereby presenting a pneumatic force against the bottom of piston 46. At the same time, the operation of solenoid 118 allows any remaining pressurized air existing in the top part of cylinder 38 to be exhausted along pressure line branch 134 through air path 108 of directional control valve 98 and finally out exhaust line 136 to speed control valve 110 and pressure dump valve 112. Concurrently, signal line branch 61 carries high pressure air to shuttle member 122 which simply channels the high pressure air to solenoid 120 to operate pressure dump valve 112. Actuation of solenoid 120 causes pressure dump valve 112 to allow air to be exhausted from exhaust line 136.

The tripping of lower end limit switch 51 therefore causes high pressurized air to enter cylinder 38 below piston 46 and causes pressurized air above piston 46 to be exhausted out pressure dump valve 112. This combination causes piston 46 to travel upward inside of cylinder 38.

Once piston 46 travels upward a sufficient distance to disengage from trip switch 52 of lower end limit valve 51, lower end limit valve 51 reverts back to a normal position of now allowing pressurized air from pilot line branch 58 to pass and therefore signal lines 60 and 61 no longer provide high pressure air to solenoids 118 and 120. However, directional control valve 98, in the preferred embodiment, is of such configuration that once activated it remains in a desired flow pattern until activated otherwise. Solenoid 120, on the other hand, upon the cut-off of signal line pressure to it, closes, stopping the exhausting of pressurized air from the upper sides of cylinder 38. Sufficient pressurized air has been exhausted at this time, however, so that the pressurized air below piston 46 is sufficient to continue moving piston 46 upward. However, the travel of piston 46 upward is restricted by the system by retaining some pressurized air above piston 46 to provide "back pressure", which though it is lower than the pressure below piston 46, serves to allow the speed of piston 46 to be controlled. Speed control valve 110 controls how much back pressure exists in front of piston 46 and therefore controls its speed.

Once reciprocating arm 18 deflects end trip switch 52 of upper end limit valve 50, high pressure air is allowed to pass through upper branch 54 of pilot line 94 into signal branch 56 which serves to actuate solenoid 116 of directional control valve 98 and solenoid 120 of pressure dump valve 112 through signal line branch 57 to shuttle 122. Thus, air flow patterns reflected by air paths 102 and 104 are presented in directional control valve 98 so that low pressure air coming out of low pressure regulator 100 on line 92 passes through air path 104 in directional control valve 98 and up pressure line branch 134 into the upper end of cylinder 38 while pressured air is exhausted out of the lower end of cylinder 38 through pressure line branch 132 and out exhaust line 136 through pressure dump valve 112. Thus, concurrently, a lower pressurized air regulated by low pressure regulator 100 is channeled into the top end of cylinder 38 whereas pressurized air is evacuated from the lower end of cylinder 38 to cause piston 46 to immediately reverse directions to a downward travel.

Again, once reciprocating arm 18 passes out of range of upper end limit switch 50, pressurized air ceases to be exhausted from the lower end of cylinder 38 because solenoid 120 is deactivated having no signal line pressure passing through upper end limit valve 50. This prohibits piston 46 from gaining too much momentum by leaving at least some pressurized air in lower end of cylinder 38 which continues to be variably exhausted through speed control 110.

As long as on/off valve 80 remains open, piston 46 will reciprocate in such a manner, alternatingly deflecting trip switches 52 of end limit valves 50 and 51 and upon such occurrence, signaling the air logic circuitry to reverse piston 46's direction without any lag time.

This smooth, controllable reciprocation is thereby suitable for oscillating finishing spray guns without lag or return time. Additional benefits are that oscillator 10 is explosion proof, being totally pneumatically powered, is less expensive than most existing reciprocators, and is easy to maintain and repair. It is to be understood that all components of the air logic circuitry are pneumatically or mechanically powered.

In the preferred embodiment, 90 pounds per square inch (psi) pressurized air is output from high pressure regulator 84. 90 psi will therefore be the high pressure maximum throughout the system and will be utilized for pilot pressure though pilot pressure line 94 and for signal pressure through signal lines 114, in addition to being used as piston lifting pressure through pressure line 90. Low pressure regulator 100, in the preferred embodiment, regulates pressurized air at 60 psi and therefore channels 60 psi pressurized air to the top of cylinder 38 when upper end limit valve 51 is actuated to cause piston 46 to travel downward. 60 psi air is utilized in this manner because the gravitational load of piston 46 requires less force to move piston 46 downward at a uniform speed than would be required to move piston 46 upward at a matching speed. It is to be understood, however, that the system can function at pressures different from those mentioned above and that the orientation of cylinder 38 can be in any direction; whether it be vertical or horizontal or somewhere inbetween. Therefore, the pressures fed into pressure lines 92 and 90 are adjustable according with the orientation of cylinder 38 and the gravitational load of piston 46. For example, if there theoretically was no gravitational load associated with piston 46, the high pressure and low pressure would be equivalent and could be 70 psi to maintain operable oscillation of piston 46. If the load of piston 46 were 10 pounds, high pressure should be approximately 70 psi whereas low pressure would be approximately 64 psi. For a 50 pound gravitational load, high pressure would be 90 psi and low pressure 62 psi.

The foregoing was a description of the preferred embodiment of the invention only and it is to be understood that changes and modifications can be made while staying within the boundaries of the invention. For example, directional control valve 98 can take on various configurations. In the preferred embodiment, directional control valve 98 is a five-way valve switchable between two different pre-determined flow patterns. Alternatively, directional control valve 98 could be comprised of five single flow path valves each operable individually or two three-way valves with common porting to pressurized dump valve 112, or one four-way ported valve with output to a side regulator and a back check valve.

The preferred embodiment of the invention has a piston stroke of approximately 24 inches and weighs approximately 150 pounds. This is a considerable difference between conventional hydraulic units which weigh many times between 1200–1800 pounds. Additionally, stroke distance can be adjustable from 4–24 inches while the unit is in operation with a fingertip control which adjusts the distances between trip switches 52 of end limit valve 50 and 51. Only one power source is required for operation of entire oscillator 10 and as a design feature, exhaust air can be piped into the interior of housing 12 to provide positive pressurization of housing 12.

Thus it can be seen that the invention meets at least all of its stated objectives.

What is claimed is:

1. A pneumatic powered oscillator comprising:

(a) a cylinder of elongated shape having first and second opposite ends, said first and second ends each having means for introducing and exhausting pressurized air;

(b) piston means having first and second opposite sides facing said first and second ends of said cylinder respectively and being slidably moveable within said cylinder between a first position closest to said first end of said cylinder, to a second position closest to said second end of said cylinder;

(c) an arm means moveably responsive to the movement of said piston means and having an outward end extending latitudinally outwardly from said cylinder;

(d) framework means removeably attachable to said outward end of said arm having extension members for the mounting of spraying means for the spraying of substances;

(e) air logic circuitry means for the channeling of pressurized air of different pressures and amounts to each of said means for intaking and exhausting pressurized air at pre-determined times determined by the position of said piston within said cylinder, said air logic circuitry introducing a pre-determined amount of pressurized air to said means for intaking and exhausting pressurized air at said first end of said cylinder when said piston reaches said first position while concurrently exhausting a pre-determined amount of pressurized air from said means for intaking and exhausting pressurized air of said second end of said cylinder and introducing a pre-determined amount of pressurized air into said means for intaking and exhausting pressurized air at said second end of said cylinder when said piston reaches said second position while concurrently exhausting a pre-determined amount of pressurized air from said means for intaking and exhausting pressurized air of said first end of said cylinder, so that upon reaching said first or second position in said cylinder, pressurized air is introduced in front of said piston and pressurized air is exhausted behind said piston causing said piston to quickly reverse directions toward the opposite end of said cylinder while taking a minimum lag time in making the reversal of direction, said air logic circuitry further comprising a manually operated on/off valve for entering pressurized air to said air logic circuitry of said oscillator, a high pressure regulator with a filter for providing a regulated supply of pressurized air and filtering out undesired elements from the air entering said air logic circuitry of said oscillator, a lubricator means for imparting certain substances to the pressurized air to increase said pressurized air's viscosity, a low pressure regulator for providing a lower pressure air supply than that entering the high pressure regulator for use in said air logic circuitry of said oscillator, and a speed control valve for selecting pre-determined amounts of exhaust pressurized air from said cylinder to control the speed of oscillation of said piston.

2. The device of claim 1 wherein said air logic circuitry comprises first and second end limit switches which sense when said piston reaches either a first or second adjustably locatable pre-determined end limit along said cylinder; a directional control valve to channel pressurized air of different pressures to and from said means for intaking and exhausting pressurized air; and a pressure dump valve to exhaust pre-determined amounts of pressurized air from said cylinder when said piston triggers either said first or second end limit switch, so that upon said piston triggering either said end limit switch, said directional control valve and said pressure dump valve respond by introducing a pre-determined amount of pressurized air ahead of said piston and exhausting a pre-determined amount of pressurized air from behind said piston causing said piston to quickly reverse directions toward the end of said cylinder with a lower pressure while taking a minimum lag time in making the reversal of direction.

3. The device of claim 1 wherein said arm means is directly attached to said piston means, said cylinder having a longitudinally disposed slot along the length of said cylinder and an air sealing means along said slot so that said arm can move along said slot without any pressurized air escaping from inside said cylinder.

4. The device of claim 1 wherein said spraying means comprises one or more spray guns which are operatively attached to a spray substance supply.

5. The device of claim 2 wherein said end limit switches comprise means for mechanically sensing the passage of said piston and transmitting that mechanical signal to a valving means which triggers said directional control valve and said pressure dump valve to exhaust pressurized air behind said piston and introduce pressurized air ahead of said piston.

6. The device of claim 2 wherein said directional control valve is a five-way air valve.

7. The device of claim 2 wherein said pressure dump valve further comprises a pneumatically controlled shuttle triggered by said limit switches, said shuttle determining whether pressurized air is exhausted from said cylinder or whether it is contained and maintained.

* * * * *